US007922302B2

(12) United States Patent
Cruz-Uribe et al.

(10) Patent No.: US 7,922,302 B2
(45) Date of Patent: Apr. 12, 2011

(54) PIEZOELECTRIC ACTUATION MECHANISM

(75) Inventors: Tony S. Cruz-Uribe, Corvallis, OR (US); Adel Jilani, Corvallis, OR (US); David Pidwerbecki, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 924 days.

(21) Appl. No.: 11/831,905

(22) Filed: Jul. 31, 2007

(65) Prior Publication Data

US 2009/0033722 A1 Feb. 5, 2009

(51) Int. Cl.
*B41J 2/045* (2006.01)

(52) U.S. Cl. ..... 347/71

(58) Field of Classification Search ..... 347/71, 347/72, 70, 69, 68; 400/124.14, 124.16; 310/311, 324, 327
See application file for complete search history.

(56) References Cited

U.S. PATENT DOCUMENTS

| | | | |
|---|---|---|---|
| 5,202,703 | A | 4/1993 | Hoisington et al. |
| 6,450,626 | B2 | 9/2002 | Ikeda et al. |
| 6,536,880 | B2 | 3/2003 | Takagi |
| 6,891,316 | B2 | 5/2005 | Yuu et al. |

FOREIGN PATENT DOCUMENTS

| | | | |
|---|---|---|---|
| JP | 1998034924 | A | 2/1998 |
| JP | 1999309858 | A | 11/1999 |
| JP | 2001-179969 | | 7/2001 |
| JP | 2002-166547 | | 6/2002 |
| JP | 2003-209303 | | 7/2003 |
| WO | 9209111 | A1 | 5/1992 |

*Primary Examiner* — K. Feggins

(57) ABSTRACT

Embodiments of the present disclosure are disclosed.

20 Claims, 14 Drawing Sheets

118
152R
154R
112
154C
202
+V
210
154L
152L
116
114
102

204
-V
118
152R
154R
112
154C
212
154L
204
-V
152L
116
114
102

204
-V
118
152R
154R
112
202
+V
154C
214
154L
204
-V
152L
116
114
102

PIEZOELECTRIC ACTUATION MECHANISM

BACKGROUND

Inkjet printing devices, such as inkjet printers, are devices that are able to form images on sheets of media like paper by ejecting ink onto the media sheets. Drop-on-demand inkjet printing devices are typically of two different types: thermal inkjet printing devices and piezoelectric inkjet printing devices. A thermal inkjet printing device ejects ink by heating the ink, which causes formation of a bubble within the ink that results in ink droplet(s) to be ejected. A piezoelectric inkjet printing device ejects ink by actuating a piezoelectric actuation mechanism, which forces ink droplet(s) to be ejected. Piezoelectric actuation mechanisms, however, are typically more susceptible to mechanical crosstalk than thermal inkjet printing devices are. Mechanical crosstalk occurs when pressurizing one inkjet chamber results in at least partially pressurization of one or more adjacent inkjet chambers. Crosstalk can be problematic insofar as it can result in image quality issues and other types of problems.

DETAILED DESCRIPTION OF THE DRAWINGS

Figure 1A:
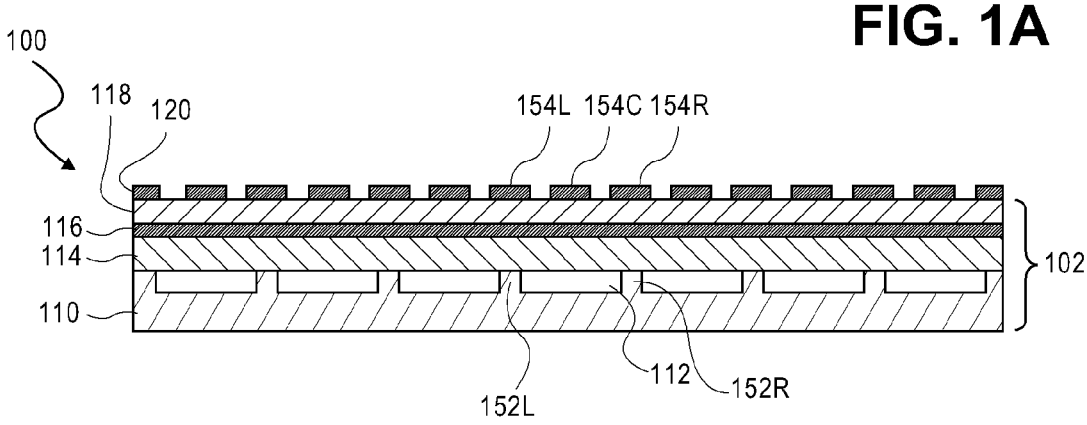
FIGS. 1A, 1B, and 1C are diagrams of a piezoelectric actuation mechanism for a piezoelectric inkjet printing device, according to varying embodiments of the present disclosure.
Figure 1B:
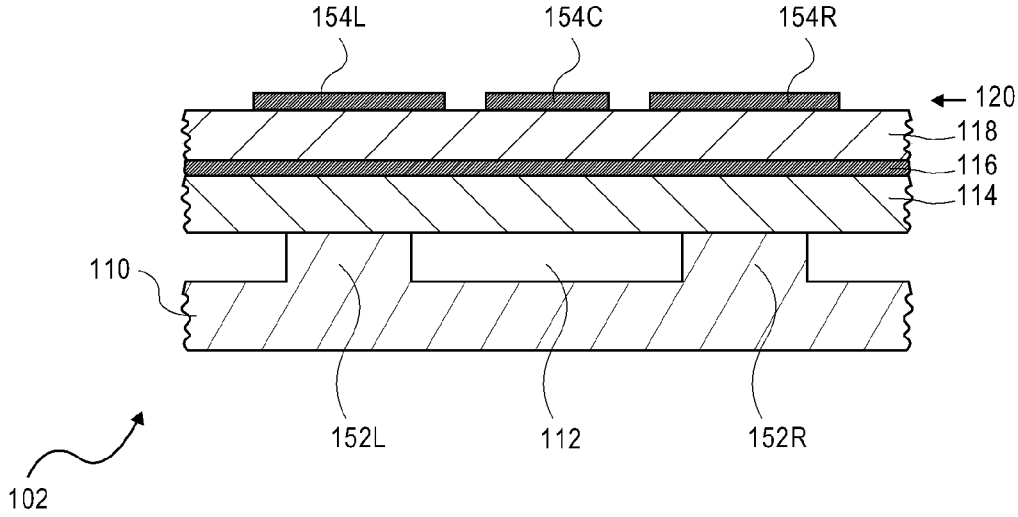

FIG. 1A shows an inkjet piezoelectric actuation mechanism 102 for a piezoelectric inkjet printing device 100, according to an embodiment of the present disclosure, while FIG. 1B shows the piezoelectric actuation mechanism 102 in more detail, according to an embodiment of the present disclosure. It is noted that FIG. 1 is not drawn to scale. In FIG. 1A, the piezoelectric inkjet printing device 100 may be an inkjet printer, an all-in-one (AIO) device having inkjet-printing capability, an industrial printer, or another type of inkjet printing device. In general operation, as can be appreciated by those of ordinary skill within the art, the piezoelectric inkjet printing device 100 ejects ink from an ink supply onto sheets of media in the form of ink droplets. Such ink ejection allows for images to be formed on the media sheets. The inkjet piezoelectric actuation mechanism 102 is thus selectively actuated to cause these ink droplets to be ejected onto a media sheet to form an image on the media sheet as desired.

Referring now to both FIGS. 1A and 1B, where FIG. 1B shows in detail a portion of the inkjet piezoelectric actuation mechanism 102 of FIG. 1A, the piezoelectric actuation mechanism 102 includes a substrate 110 in which a number of chambers, such as the chamber 112, have been formed. It can thus be said that the substrate 110 defines these chambers. The chambers are voids separated by sidewalls. For instance, the chamber 112 has a left sidewall 152L and a right sidewall 152R, collectively referred to as the sidewalls 152. It can also be said that the substrate 110 defines these sidewalls. The substrate 110 may be silicon, ceramic, glass, stainless steel, or another type of material that may be readily micro-machined and non-reactive with inks.

The inkjet piezoelectric actuation mechanism 102 further includes a diaphragm 114 disposed over the substrate 110. The diaphragm 114 can be flexible and may be silicon, ceramic, glass, stainless steel, or another type of material. The diaphragm 114 may also be referred to as a membrane. The diaphragm 114 is specifically rigidly mounted to the sidewalls of the substrate 110. The piezoelectric actuation mechanism 102 also includes a common electrode 116 disposed over the diaphragm 114. The common electrode 116 is considered common in that it is shared by all the chambers defined within the substrate 110.

The inkjet piezoelectric actuation mechanism 102 further includes a piezoceramic sheet 118 disposed over the common electrode 116. In the embodiment of FIG. 1A, the piezoceramic sheet 118 is an unpatterned, continuous sheet. This can be advantageous where patterning the piezoceramic sheet 118, such as by sawing, etching, or laser ablating, is a relatively difficult and/or expensive process. The piezoceramic sheet 118 may be fabricated from a material such as barium titanate, lead zirconium titanate (PZT), or PZT doped with small amounts of metals including, for instance, niobium or lanthanum. The piezoceramic sheet 118 has the property by which upon being subjected to an electric field, the sheet 118 responds by expansion, contraction, stretching, and/or compressing, which ultimately results in ejection of ink droplets by the piezoelectric actuation mechanism 102.

The piezoceramic sheet 118 is, thus, a piezoelectric material, which is a type of material that changes dimensions in a controlled manner proportional to the size of the applied electric field. The change in width for a rectangular region of the piezoceramic sheet 118 attached to the diaphragm 114 above the chamber 112 causes the diaphragm 114 to bend. The displacement of the diaphragm 114 into the chamber 112 creates a positive pressure which pushes ink out of an orifice to eject a droplet of ink. By comparison, a displacement away from the chamber 112 creates a negative pressure that draws ink into the chamber 112 from an ink supply, as can be appreciated by those of ordinary skill within the art.

The inkjet piezoelectric actuation mechanism 102 also includes a patterned electrode layer 120. The patterned electrode layer 120 starts as a continuous electrode layer, like the common electrode 116, that is patterned to form a number of electrodes for each chamber defined within the substrate 110. For instance, using the chamber 112 as an example, there are a left sidewall electrode 154L, a center electrode 154C, and a right sidewall electrode 154R, collectively referred to as the electrodes 154, for the chamber 112. The electrodes 154 are discrete, in that they can be electrically isolated from one another. As such, each of the electrodes 154 can in one embodiment have a voltage applied to it without causing this voltage to be applied to other of the electrodes 154.

The electrode 154L is referred to as a left sidewall electrode because it is substantially centered over the left sidewall 152L of the chamber 112. Likewise, the electrode 154R is referred to as a right sidewall electrode because it is substantially centered over the right sidewall 152R of the chamber 112. The electrode 154C is referred to as a center electrode because it is substantially centered over the chamber 112 itself, specifically over the center of the chamber 112.

There are center, left sidewall, and right sidewall electrodes for each chamber defined within the substrate 110. Specifically, each chamber has its own center electrode. However, except for the first (left-most) chamber defined within the substrate 110, the left sidewall electrode for each chamber is also the right sidewall electrode for the preceding (to the left) adjacent chamber. Likewise, except for the first (left-most) chamber, the left sidewall of each chamber is also the right sidewall of the preceding (to the left) adjacent chamber. Similarly, except for the last (right-most) chamber defined within the substrate 110, the right sidewall electrode for each chamber is also the left sidewall electrode for the successive (to the right) adjacent chamber. Likewise, except for the last (right-most) chamber, the right sidewall of each chamber is also the left sidewall of the successive (to the right) adjacent chamber.

It is noted that FIGS. 1A and 1B are not drawn to scale for illustrative clarity. In one embodiment, the substrate 110 may have a thickness of 760 microns, the diaphragm 114 may have a thickness of 30 microns, the common electrode 116 may have a thickness of 1 micron, the piezoceramic sheet 118 may have a thickness of 15 microns, and the electrode layer 120 may have a thickness of 0.2 micron. In this embodiment, the chambers defined within the substrate 110 may each have a width of 410 microns and a depth of 90 microns, and the sidewalls of these chambers may each have a width of 50 microns and the same depth as the chambers.

Furthermore, in one embodiment, the center electrodes for the chambers may each have a width that extends substantially 60% over the width of a corresponding chamber, such that the center electrodes do not extend over the sidewalls of this chamber. For example, the center electrode 154C may have a width that extends substantially 60% over the width of the chamber 112. In this embodiment, the sidewall electrodes for the chambers, except for the first (left most) and the last (right most) chambers, may each have a width that extends substantially over 6% of the widths of two corresponding chambers. For example, the electrode 154L may have a width that extends substantially over 6% of the width of the chamber 112 (on the left side of the chamber 112) and over 6% of the width of the chamber to the left of the chamber 112 (on the right side of this chamber). Similarly, the electrode 154R may have a width that extends substantially over 6% of the width of the chamber 112 (on the right side of the chamber 112) and over 6% of the width of the chamber to the right of the chamber 112 (on the left side of this chamber).

Figure 1C:
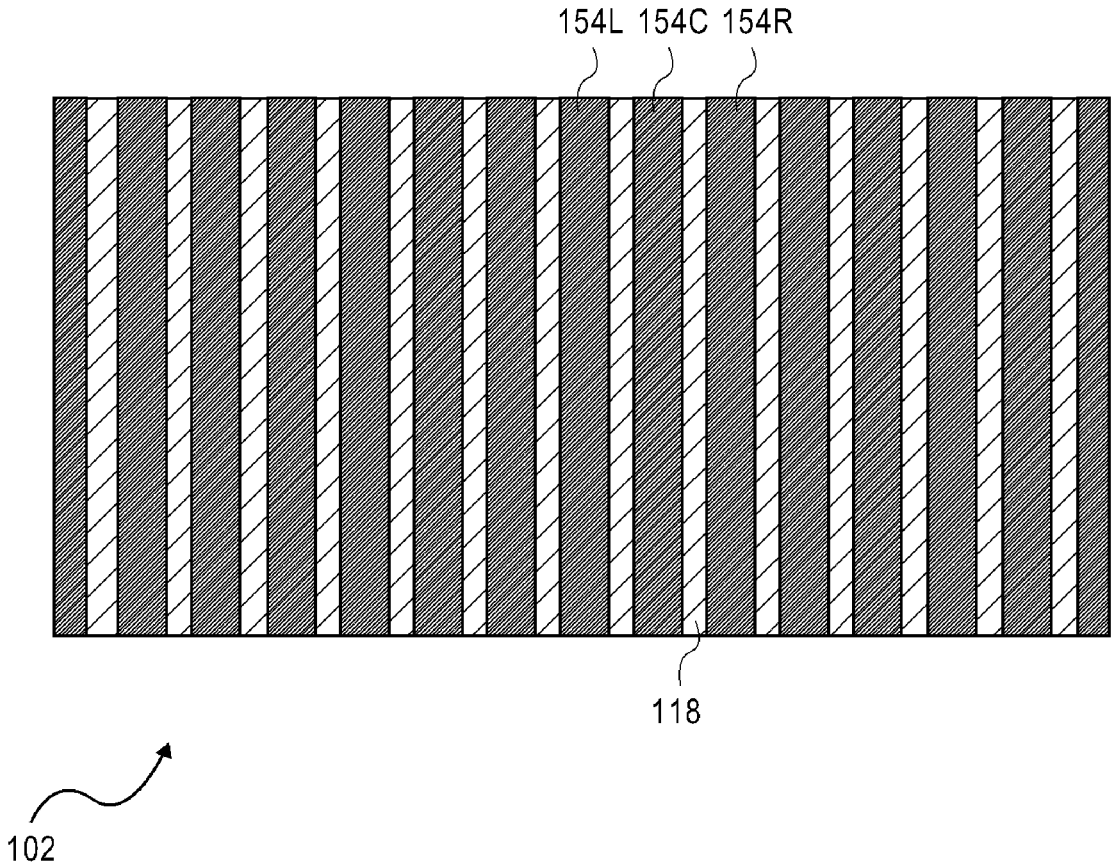

FIG. 1C shows a top view of the piezoelectric actuation mechanism 102 of FIG. 1A, according to an embodiment of the present disclosure. As such, electrodes including the electrodes 154L, 154C, and 154R are visible. Also visible in FIG. 1C is the piezoceramic sheet 118. In one embodiment, the electrodes each span a length of approximately 3 millimeters (mm), such that the chambers under the electrodes are also 3 mm in length. It is noted that FIG. 1C is not drawn to scale.

Figures 2A, 2B, 2C:
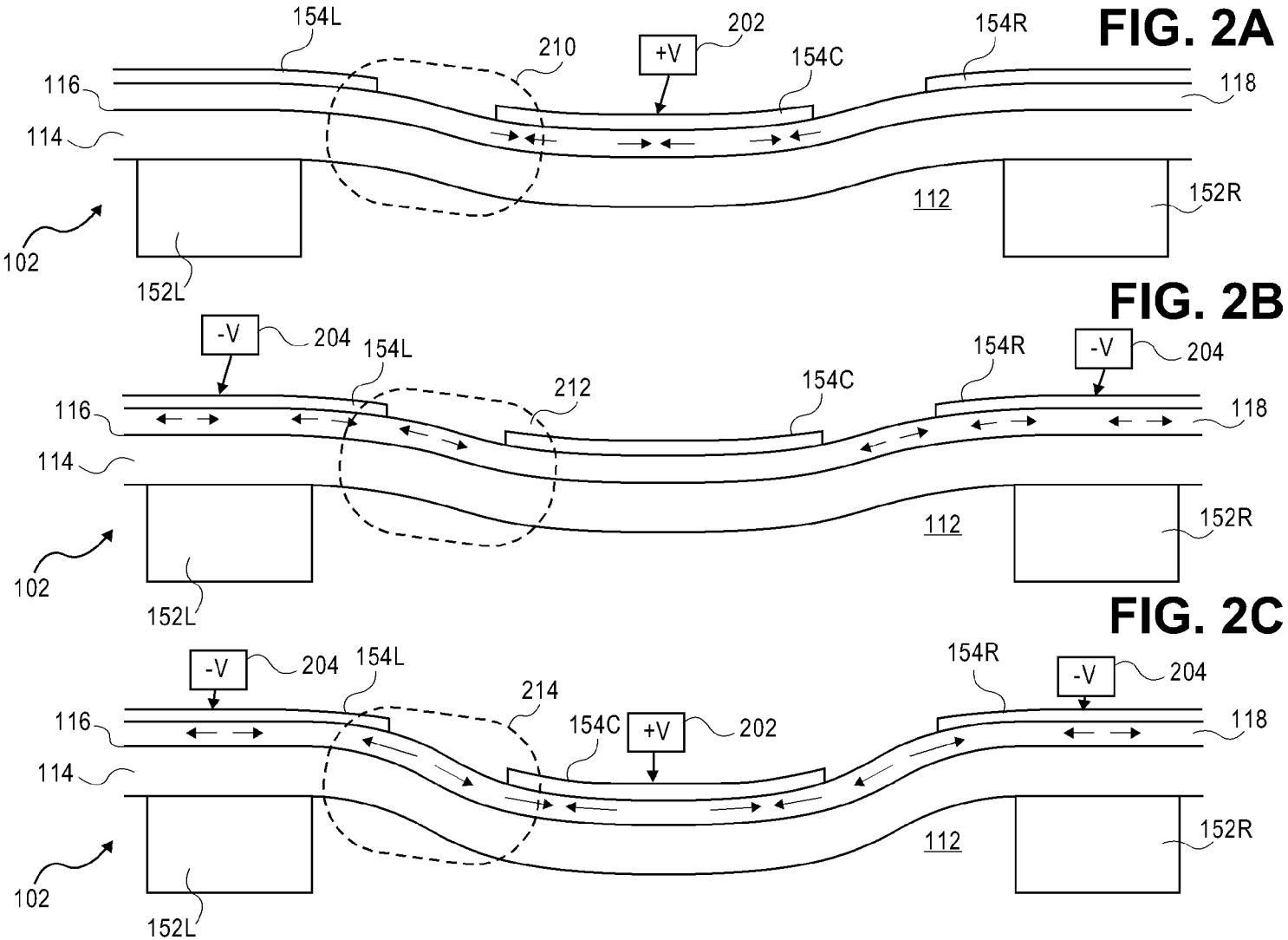
FIGS. 2A, 2B, and 2C are diagrams showing how a piezoelectric actuation mechanism responds upon application of various voltages to various electrodes of the mechanism, according to different embodiments of the present disclosure.

FIGS. 2A, 2B, and 2C show how the piezoelectric actuation mechanism 102 is responsive upon application of various voltages to the electrodes 154, according to different embodiments of the present disclosure. The responsiveness of the piezoelectric actuation mechanism 102 is particularly depicted in relation to the chamber 112. Thus, FIGS. 2A, 2B, and 2C show the chamber 112 and its sidewalls 152L and 154R, as well as the diaphragm 114, the common electrode 116, the piezoceramic sheet 118, and the electrodes 154 for the chamber 112.

In FIG. 2A, a positive voltage 202 relative to the common ground electrode 116 is applied to the center electrode 154C, while the left electrode 154L and the right electrode 154R are left to float. That is, no voltage is applied to the electrodes 154L and 154R, and the electrodes 154L and 154R are further not grounded. In response to the voltage 202 applied to the electrode 154C, the piezoceramic sheet 118 actively contracts within the region under the electrode 154C, as indicated by the pairs of inward-pointing arrows in FIG. 2A. Furthermore, because the piezoceramic sheet 118 is attached to the diaphragm 114 that is attached to the sidewalls 152L and 152R, the piezoceramic sheet 118 contracts within the region between each of the electrodes 154L and 154R and the chamber 112. The top of the diaphragm 114 is forced to be compressed by being rigidly attached to the piezoceramic sheet 118. The diaphragm 114 thus bends toward the chamber 112 and undergoes stretching along its chamber side portion. The net effect is that the piezoceramic sheet 118, and thus the diaphragm 114, is displaced into the chamber 112, decreasing the volume of the chamber 112.

In FIG. 2B, a negative voltage 204 is applied to each of the electrodes 154L and 154R, while the center electrode 154C is left to float, such that the electrode 154C has no voltage applied to it and further is not grounded. In response to the voltage 204 applied to the electrodes 154L and 154R, the piezoceramic sheet 118 actively expands within the region under each of the electrodes 154L and 154R, as indicated by the pairs of outward-pointing arrows in FIG. 2B. Furthermore, because the piezoceramic sheet 118 is attached to the diaphragm 114 that is attached to the sidewalls 152L and 152R, the piezoceramic sheet 118 is compressed within the region under the electrode 154C. The net effect is again that the piezoceramic sheet 118, and thus the diaphragm 114, is displaced into the chamber 112, decreasing the volume of the chamber 112. Where the voltage 204 applied in FIG. 2B is equal in magnitude to the voltage 202 applied in FIG. 2A, such displacement in FIG. 2B is less than the displacement in FIG. 2A.

In FIG. 2C, a positive voltage 202 is applied to the electrode 154C and a negative voltage 204 is applied to each of the electrodes 154L and 154R. In response to the voltage 202 being applied to the electrode 154C, the piezoceramic sheet 118 actively contracts within the region under the electrode 154C, as indicated by the pairs of inward-pointing arrows in FIG. 2C. Likewise, in response to the voltage 204 being applied to each of the electrodes 154L and 154R, the piezoceramic sheet 118 actively expands within the region under each of the electrodes 154L and 154R, as indicated by the pairs of outward-pointing arrows in FIG. 2C. The net effect is again that the piezoceramic sheet 118, and thus the diaphragm 114, is displaced into the chamber 112, decreasing the volume of the chamber 112. Where the voltage 204 applied in FIGS. 2C and 2B is equal in magnitude to the voltage 202 applied in FIGS. 2C and 2A, such displacement in FIG. 2C is greater than the displacement in FIG. 2A and the displacement in FIG. 2B.

Figure 3A:
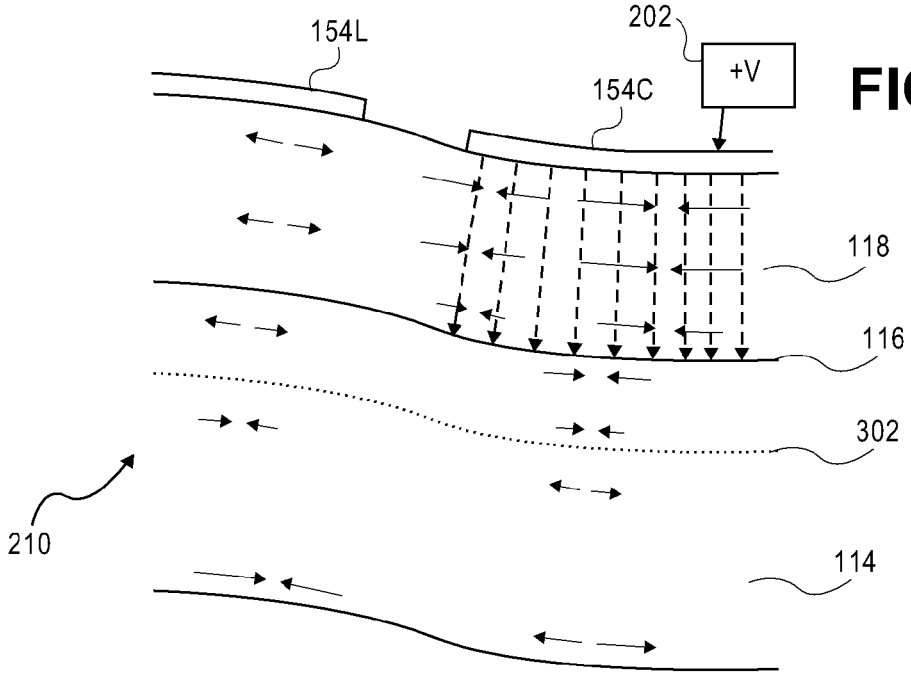
FIGS. 3A, 3B, and 3C are diagrams showing how electric fields are distributed within the piezoelectric actuation mechanisms when voltages are applied in accordance with FIGS. 2A, 2B, and 2C, respectively, according to different embodiments of the present disclosure.
Figure 3B:
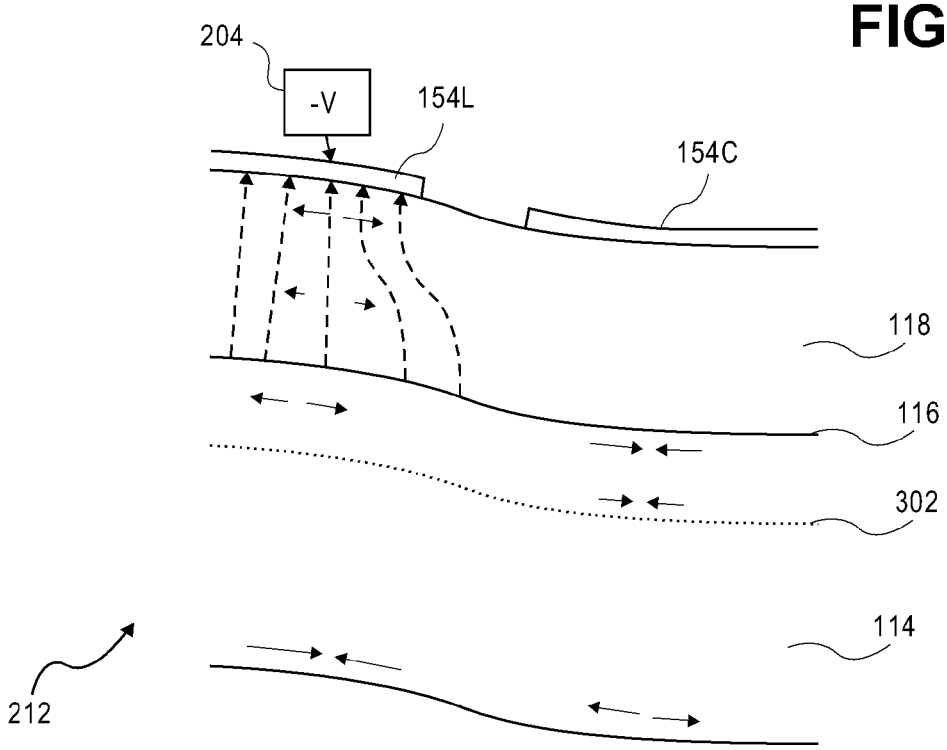
Figure 3C:
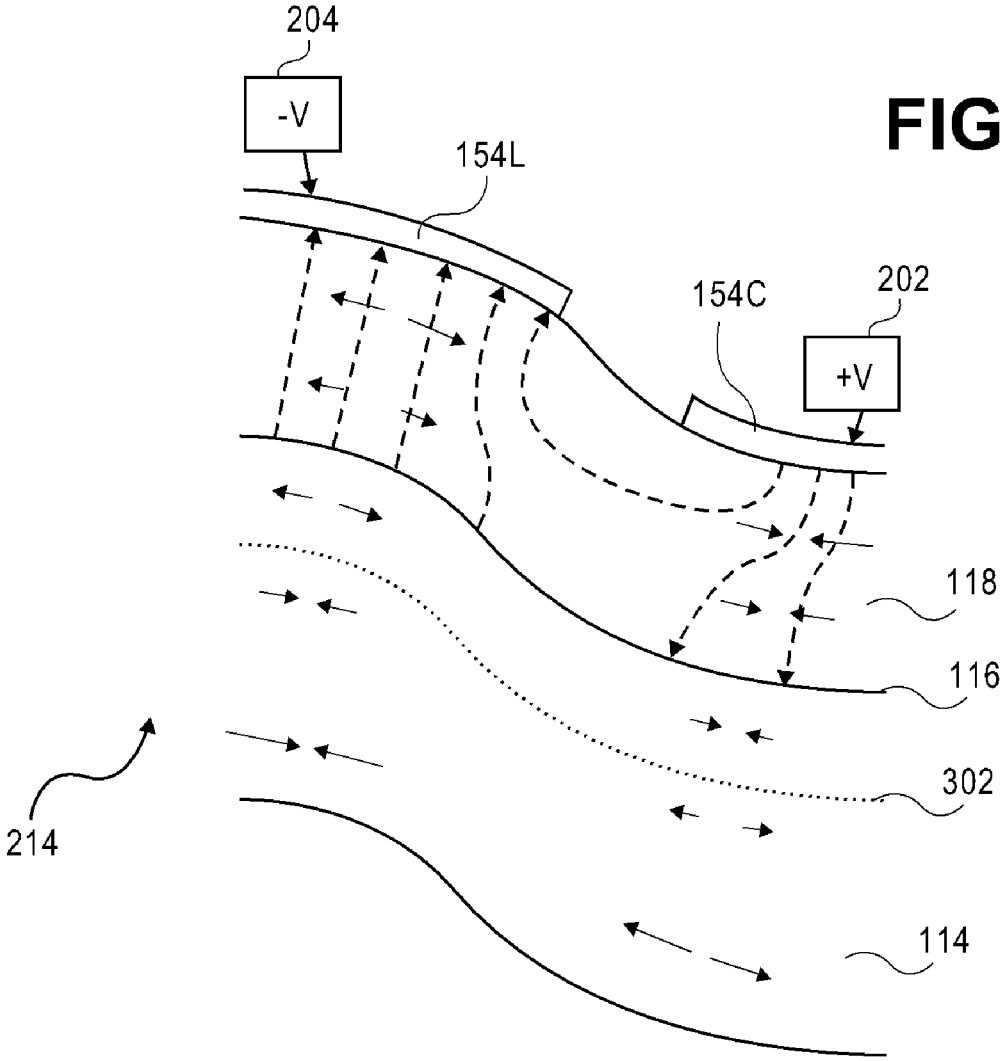

FIGS. 3A, 3B, and 3C shows schematically the electric fields that result when the piezoelectric actuation mechanism 102 has voltages applied to the electrodes 154 in correspondence with FIG. 2A, 2B, and 2C, respectively, according to different embodiments of the present disclosure. For instance, FIG. 3A shows the electric fields that result in the region 210 of FIG. 2A. Likewise, FIG. 3B shows the electric fields that result in the region 212 of FIG. 2B, and FIG. 3C shows the electric fields that result in the region 214 of FIG. 2C. The magnitude and direction of the electric fields are typically depicted with electric field lines, which are indicated in FIGS. 3A, 3B, and 3C by dashed arrows.

In FIG. 3A, then, where the voltage 202 is applied to the center electrode 154C and the left electrode 154L and the right electrode 154R float, the electric field extends through the piezoelectric sheet 118 from the center electrode 154C to the common electrode 116 within the region 210. This is indicated by the dashed arrows from the electrode 154C to the electrode 116 within the sheet 118. The common electrode 116 serves as ground. The active contraction within the piezoelectric sheet 118 that has been described in relation to FIG. 2A also causes the diaphragm 114 to compress in regions closer to the piezoelectric sheet 118, as indicated by the pairs of inward-facing arrows within the diaphragm 114. By comparison, regions of the diaphragm 114 farther from the piezoelectric sheet 118 stretch, as indicated by the pairs of outward-facing arrows within the diaphragm 114. Therefore, there is an imaginary neutral plane 302 that can be defined within the diaphragm 114 at which the diaphragm 114 is neither being compressed nor being stretched.

In FIG. 3B, where the voltage 204 is applied to the left electrode 154L and the right electrode 154R, and the center electrode 154C floats, the electric field extends through the piezoelectric sheet 118 from the common electrode 116 to the left electrode 154L within the region 212. This is indicated by the dashed arrows from the electrode 116 to the electrode 154L within the sheet 118. The common electrode 116 serves as ground. The active expansion within the piezoelectric sheet 118 that has been described in relation to FIG. 2B also causes the diaphragm 114 to compress in regions closer to the piezoelectric sheet 118, as indicated by the pairs of inward-facing arrows within the diaphragm 114. By comparison, regions of the diaphragm 114 father away from the piezoelectric sheet 118 stretch, as indicated by the pairs of outward-facing arrows within the diaphragm 114. As before, there is an imaginary neutral plane 302 that can be defined within the diaphragm 114 at which the diaphragm 114 is neither being compressed nor being stretched.

In FIG. 3C, where the voltage 202 is applied to the center electrode 154C, and the voltage 204 is applied to the left and the right electrodes 154L and 154R, the electric field extends through the piezoelectric sheet 118 in three ways in the region 212, as indicated by the dashed arrows within the sheet 118. First, the electric field extends from the electrode 154C to the common electrode 116 within the piezoelectric sheet 118, as in FIG. 3A. Second, the electric field extends from the common electrode 116 to the electrode 154L within the sheet 118, as in FIG. 3B. Third, the electric field also extends from the electrode 154C to the electrode 154L within the piezoelectric sheet 118, as in FIG. 3C. The common electrode 116 serves as ground. The active expansion and contraction within the piezoelectric sheet 118 that has been described in relation to FIG. 2C also causes the diaphragm 114 to compress in regions closer to the piezoelectric sheet 118 under the electrode 154C and to stretch in regions farther from the sheet 118 in regions under the electrode 154C. Similarly, the diaphragm 114 is caused to stretch in regions closer to the piezoelectric sheet 118 under the electrode 154L and to compress in regions farther from the sheet 118 in regions under the electrode 154L. As before, there is an imaginary neutral plane 302 that can be defined within the diaphragm 114 at which the diaphragm 114 is neither being compressed nor being stretched.

FIGS. 4A, 4B, 4C, 4D, and 4E show the displacement in relation to the chamber 112 of the piezoelectric actuation mechanism 102 caused by application of voltages to various of the electrodes 154, according to different embodiments of the present disclosure. FIGS. 4A-4E are representations of finite element analysis (FEA) diagrams. For illustrative convenience and clarity, the diaphragm 114, the common electrode 116, the piezoceramic sheet 118, and the electrodes 154 are collectively depicted in FIGS. 4A, 4B, 4C, 4D, and 4E as a portion 402 of the piezoelectric actuation mechanism 102. As such, just the substrate 114, the chamber 112 defined by the substrate 110, and the sidewalls 152L and 152R also defined by the substrate 110 are depicted in FIGS. 4A, 4B, 4C, 4D, and 4E. The chamber 112 in the embodiments of FIGS. 4A, 4B, 4C, 4D, and 4E has a length (not depicted) of 3,000 microns, not including the widths of the sidewalls 152L and 152R, which may each have a width of 50 microns.

Figure 4A:
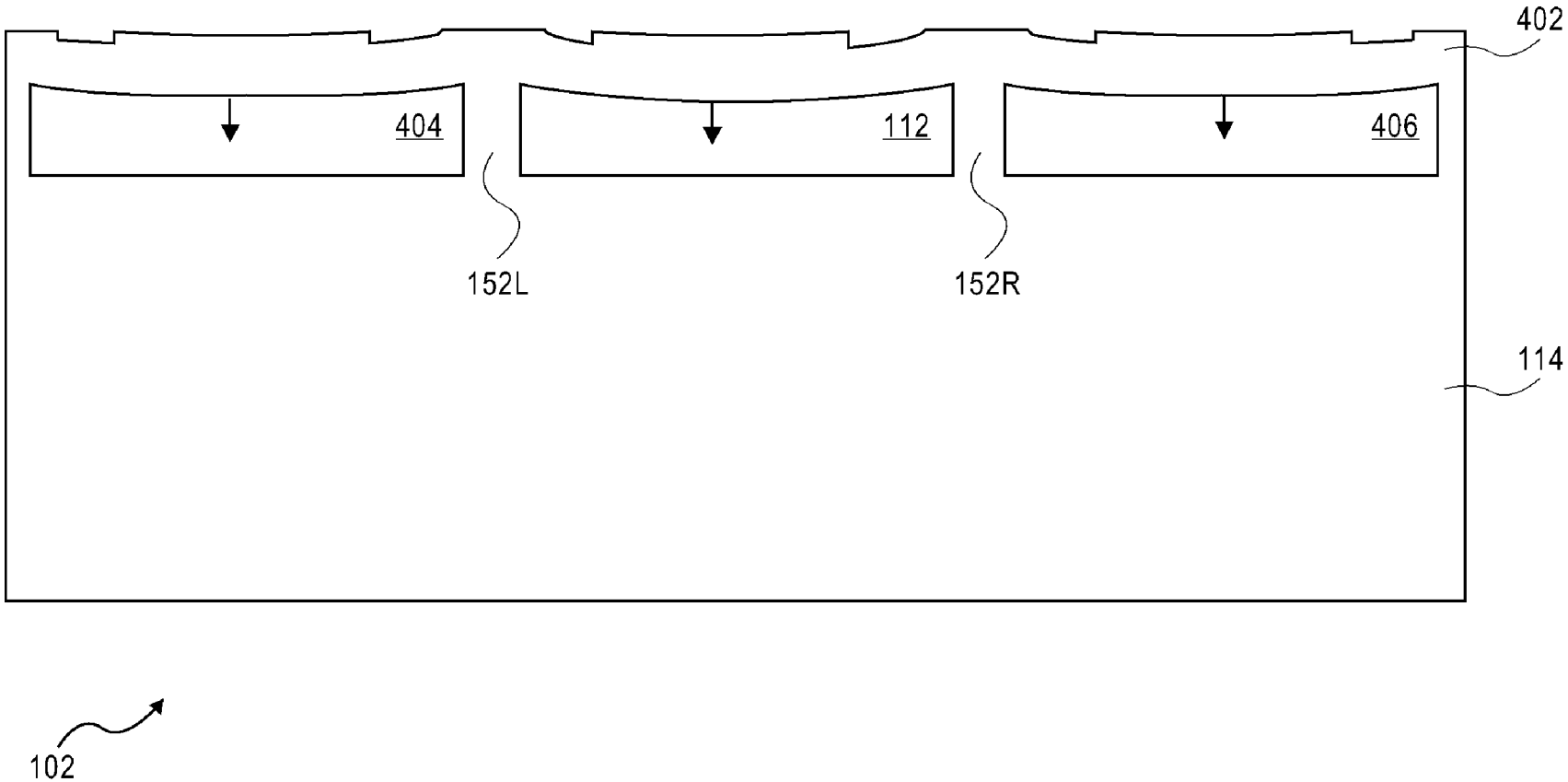
FIGS. 4A, 4B, 4C, 4D, and 4E are diagrams showing how displacement occurs within a piezoelectric actuation mechanism upon application of various voltages to various electrodes of the mechanism, according to different embodiments of the present disclosure.

In FIG. 4A, the left sidewall electrode 154L and the right sidewall electrode 154R have a voltage of −10 volts applied thereto, while the center electrode 154C is permitted to float, to selectively actuate the chamber 112. The result is that the portion 402 of the piezoelectric actuation mechanism 102 over the chamber 112 is displaced by −32.6 nanometers (nm) at its maximum point, such that the chamber 112 yields a decrease in volume of 25.2 picoliters (pl). (It is noted that displacement and volume change are related to the length of the chamber 112, as can be appreciated by those of ordinary skill within the art.) However, the portion 402 over the chamber to the left of the chamber 112, which is referred to as the chamber 404, and the portion 402 over the chamber to the right of the chamber 112, which is referred to as the chamber 406, also are displaced, by −17.3 nm at their maximum points. The chambers 404 and 406 themselves decrease in volume by 12.6 pl. The partial actuation of the chambers 404 and 406 when the chamber 112 is selectively actuated, which is referred to as "crosstalk herein,"can be disadvantageous.

Figure 4B:
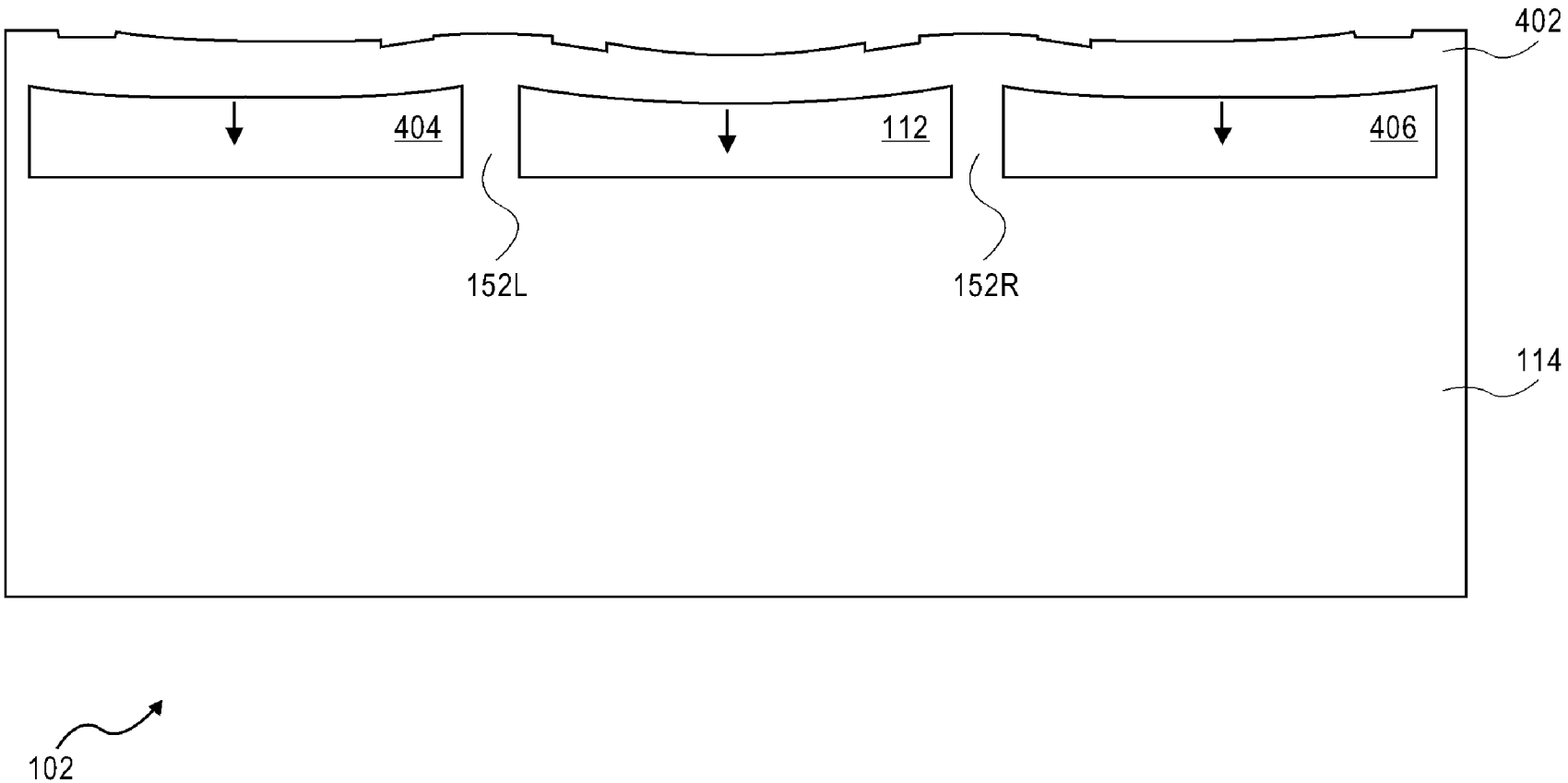

In FIG. 4B, the left sidewall electrode 154L and the right sidewall electrode 154R again have a voltage of −10 volts applied thereon, but the center electrode 154C is grounded, to selectively actuate the chamber 112. The result is that the portion 402 of the piezoelectric actuation mechanism 102 over the chamber 112 is displaced by −37.6 nm at its maximum point, such that the chamber 112 yields a volume decrease of 28.8 pl. However, the portion 402 over the adjacent chamber 404, and the portion 402 over the adjacent chamber 406, are also still displaced, by −20.0 nm at their maximum points, with a volume decrease of 13.8 pl in each of the chambers 404 and 406. Thus, grounding the center electrode 154C in FIG. 4B, as opposed to letting it float, as in FIG. 4A, does not provide for a decrease in crosstalk.

Figure 4C:
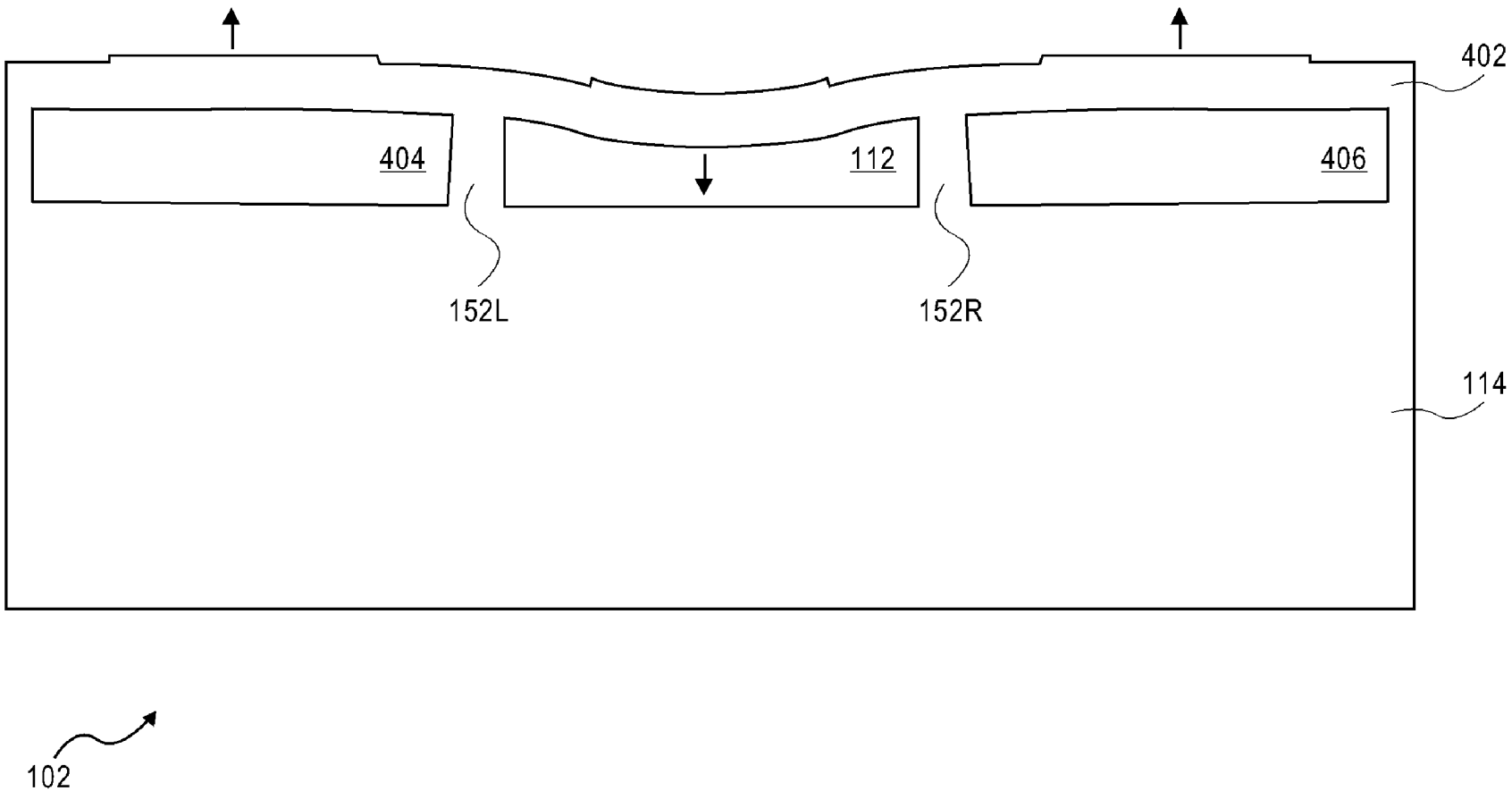

In FIG. 4C, the center electrode 154C has a voltage of +10 volts applied thereon, while the left and the right sidewall electrodes 154L and 154R are permitted to float. The result is that the portion 402 over the chamber 112 is displaced by −53.5 nm at its maximum point, such that the chamber 112 achieves a volume decrease of 42.0 pl. However, the portion 402 over the adjacent chamber 404, and the portion 402 over the adjacent chamber 406, are also still displaced, but in the opposite direction, by 9.1 nm at their maximum points, such that the chambers 404 and 406 each increase in volume by 7.2 pl. Therefore, applying a voltage to just the center electrode 154C, as in FIG. 4C, still results in crosstalk.

Figure 4D:
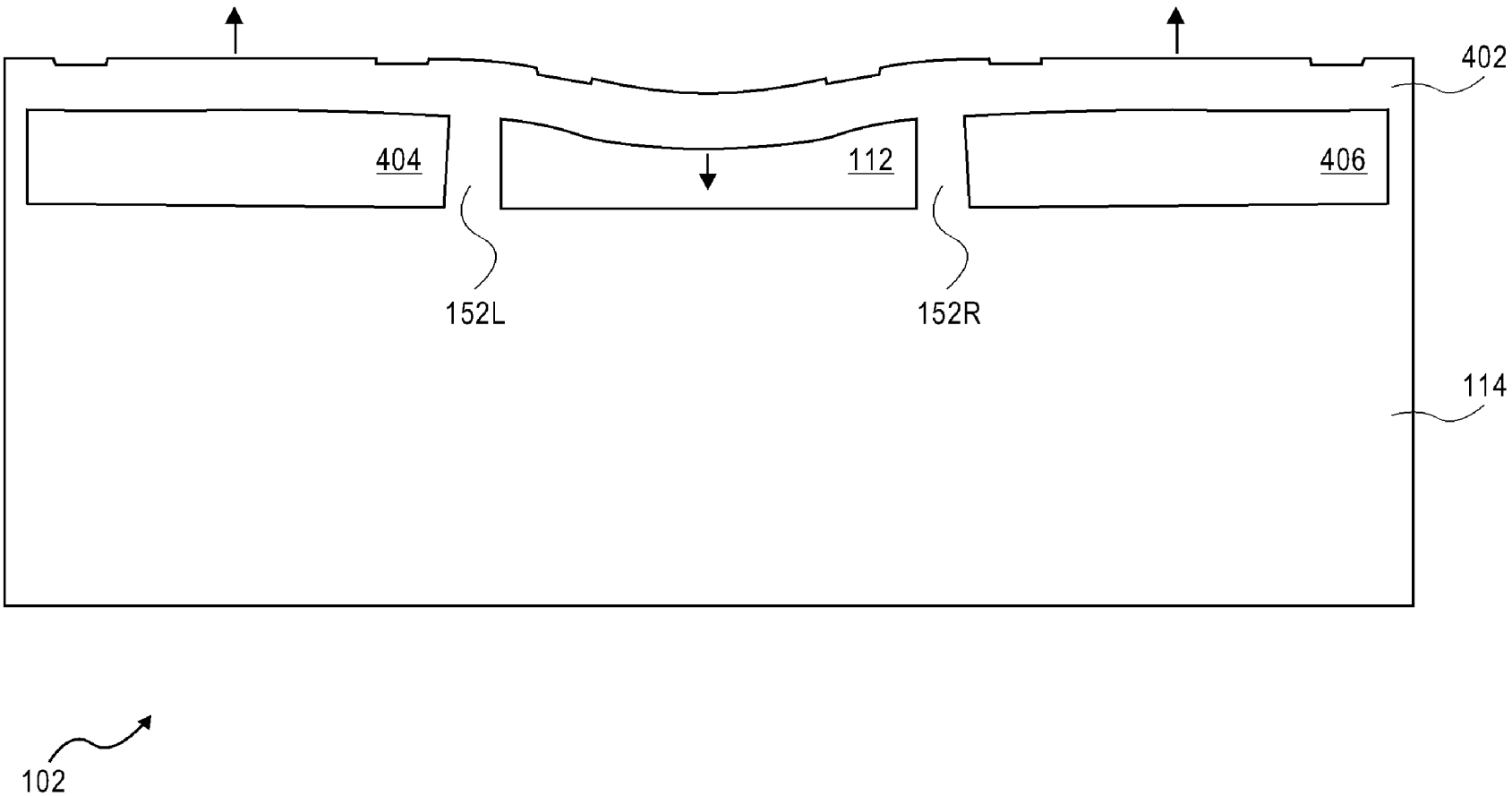

In FIG. 4D, the center electrode 154D has a voltage of +10 volts applied thereon, while the left and the right sidewall electrodes 154L and 154R are both grounded. The result is that the portion 402 over the chamber 112 is displaced by −58.6 nm at its maximum point, such that the chamber 112 achieves a volume decrease of −52.8 pl. The portion 402 over the adjacent chamber 404, and the portion 402 over the adjacent chamber 406, are also still displaced, again in the opposite direction, by 7.2 nm at their maximum points. The chambers 404 and 406 each increase in volume by 5.4 pl. Therefore, grounding the sidewall electrodes 154L and 154R in FIG. 4D, as opposed to letting them float as in FIG. 4C, decreases crosstalk.

Figure 4E:
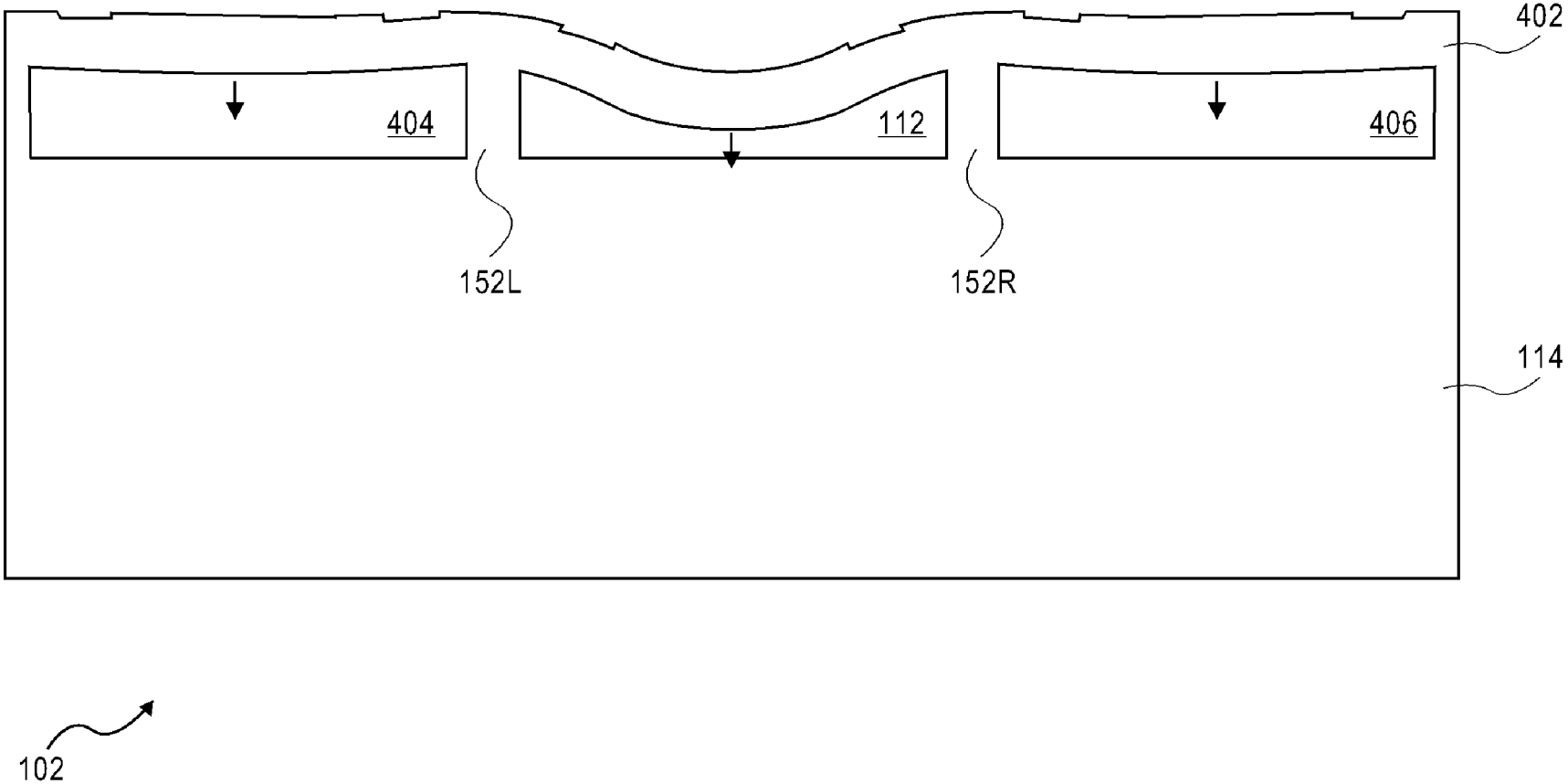

In FIG. 4E, the center electrode 154D again has a voltage of +10 volts applied thereon, while the left and the right sidewall electrodes 154L and 154R each have a voltage of −10 volts applied thereon. The result is that the portion 402 over the chamber 112 is displaced by −97.3 nm at its maximum point, such that the chamber 112 decreases in volume by 75.6 pl. The portion 402 over the adjacent chamber 404, and the portion 402 over the adjacent chamber 406, are displaced in the same direction, by −9.5 nm at their maximum points. The chambers 404 and 406 each decrease in volume by 6.0 pl. Thus, applying a voltage to each of the electrodes 154 in FIG. 4E provides for a maximum decrease in crosstalk compared to FIGS. 4A, 4B, 4C, and 4D, where crosstalk may be indicated as a percentage of adjacent chamber displacement or volume change relative to selected chamber displacement or volume change.

Furthermore, the voltages applied to the electrodes 154 can be varied to minimize crosstalk to substantially zero. For instance, the following table depicts that where a voltage of +10 volts is applied to the center electrode 154C, the (negative) voltage applied to each of the left and the right sidewall electrodes 154L and 154R can be varied to minimize crosstalk.

| Voltage at each sidewall electrode (in Volts) | Voltage at center electrode (in Volts) | Change in selected chamber volume (in picoliters) | Change in adjacent chamber volume (in picoliters) |
|---|---|---|---|
| 0 | 10 | −45.6 | 6 |
| −1 | 10 | −48.0 | 4.8 |
| −2 | 10 | −51.6 | 3.6 |
| −3 | 10 | −54.0 | 2.4 |
| −4 | 10 | −57.6 | 1.2 |
| −5 | 10 | −60.0 | 0.0 |
| −6 | 10 | −63.6 | −1.2 |
| −7 | 10 | −66.0 | −2.4 |
| −8 | 10 | −69.2 | −3.6 |
| −9 | 10 | −72.0 | −4.8 |
| −10 | 10 | −75.6 | −6 |

Thus, where the center electrode 154C has a voltage of 10 volts applied thereto, and the left and the right sidewall electrodes 154L and 154R each have a voltage of −5 volts applied thereto, the chamber 112 decreases in volume by 60 pl, but the chambers 404 and 406 do not change in volume at all, such that crosstalk can be said to have been eliminated.

The example presented in relation to FIG. 4E presumes that the sidewall electrodes 152L and 152R, as well as all the sidewall electrodes in FIG. 1, can be independently selected, such that different voltages can be asserted on different sidewall electrodes as desired. In some situations, this may be unrealistic, insofar as separate leads may then be needed for each sidewall electrode, which may not be able to be realized without increasing die size, for instance, as can be appreciated by those of ordinary skill within the art. Therefore, in one embodiment, all the sidewall electrodes may be electrically coupled to one another, such that a voltage applied on one sidewall electrode is applied to all the sidewall electrodes. That is, regardless of whether a given chamber is selected or actuated by applying a voltage to its corresponding center electrode, the sidewall electrodes for all the chambers have a (same) voltage applied thereto.

The following table illustrates that where a voltage of +10 volts is applied to the center electrode 154C, the (negative) voltage applied to all the sidewall electrodes of FIG. 1, including the left and the right sidewall electrodes 154L and 154R, can be varied to again minimize crosstalk.

| Voltage at each sidewall electrode (in Volts) | Voltage at center electrode (in Volts) | Change in selected chamber volume (in picoliters) | Change in adjacent chamber volume (in picoliters) |
|---|---|---|---|
| 0 | 10 | −45.6 | 5.4 |
| −1 | 10 | −49.2 | 3.0 |
| −2 | 10 | −51.6 | 0.6 |
| −3 | 10 | −55.2 | −1.8 |
| −4 | 10 | −57.6 | −4.2 |
| −5 | 10 | −61.2 | −6.6 |
| −6 | 10 | −63.6 | −9.0 |
| −7 | 10 | −67.2 | −11.4 |
| −8 | 10 | −69.6 | −13.8 |
| −9 | 10 | −73.2 | −16.2 |
| −10 | 10 | −75.6 | −18.6 |

Therefore, in such an embodiment, applying a voltage of −2 volts at all the sidewall electrodes of the piezoelectric actuation mechanism 102 minimizes crosstalk when a voltage of +10 volts is applied to a center electrode to actuate or select the chamber to which this center electrode corresponds. Additional methods of operation may include actuating the center electrodes of non-ejecting chambers at a voltage to counterbalance the extended influence of the multiply actuated sidewall electrodes.

Embodiments of the present disclosure that have been presented thus far are in relation to a piezoceramic sheet 118 that is continuous and unpatterned. For instance, the piezoceramic sheet 118 of the piezoelectric actuation mechanism 102 of the inkjet printing device 100 is continuous and unpatterned. However, in other embodiments, the piezoceramic sheet 118 may be discontinuous and patterned.

Figure 5A:
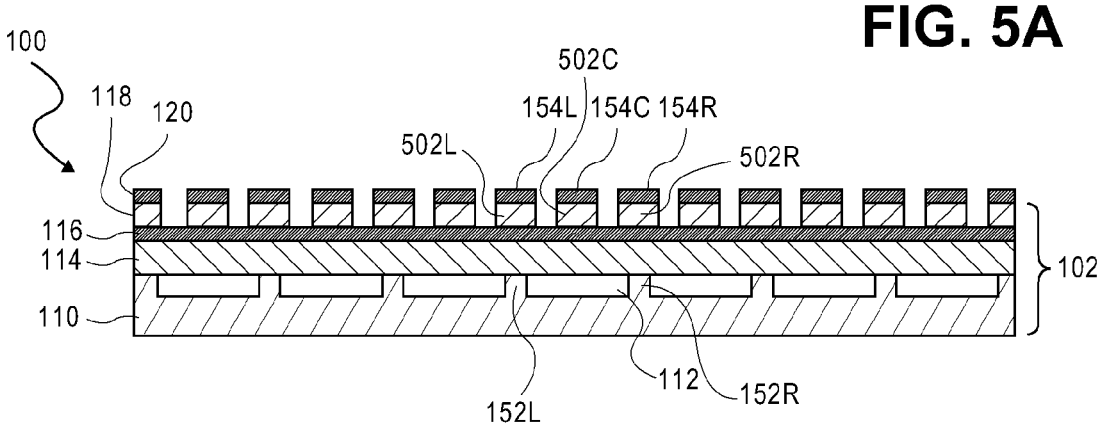
FIGS. 5A and 5B are diagrams of a piezoelectric actuation mechanism for a piezoelectric inkjet printing device, according to other varying embodiments of the present disclosure.
Figure 5B:
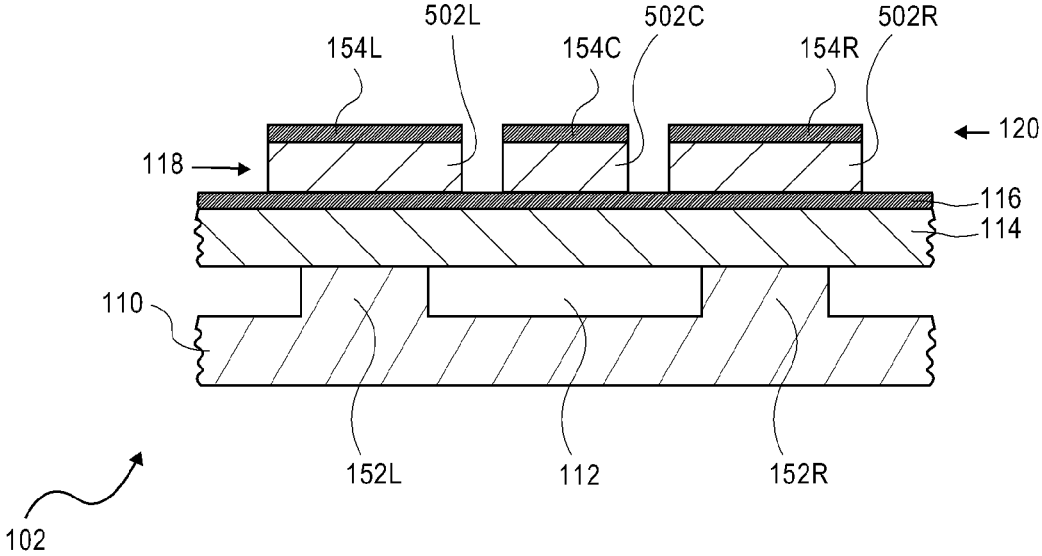

FIG. 5A shows the inkjet piezoelectric actuation mechanism 102 for the piezoelectric inkjet printing device 100, according to such an embodiment of the present disclosure, while FIG. 5B shows the piezoelectric actuation mechanism 102 of FIG. 5A in more detail, according to such an embodiment of the present disclosure. The printing device 100 of FIG. 5A and the piezoelectric actuation mechanism 102 of FIGS. 5A and 5B is the same as that which has been described in relation to FIGS. 1A and 1B, except that the piezoceramic sheet 118 is discontinuous and patterned. It is noted that FIG. 5A is not drawn to scale.

More specifically, the piezoceramic sheet 118 in the embodiments of FIGS. 5A and 5B is patterned into portions that correspond to the discrete electrodes within the electrode layer 120. For instance, for the discrete electrodes 154L, 154C, and 154R, there are corresponding piezoceramic portions 502L, 502C, and 502R, collectively referred to as the piezoceramic portions 502. The widths of the piezoceramic portions 502 may be at least substantially identical to the widths of the corresponding discrete electrodes 154. Other components identified in FIGS. 5A and 5B are those that have been described in relation to FIGS. 1A and 1B, and the description thereof is not provided again in relation to FIGS.

5A and 5B to avoid redundancy. In practice, patterned piezoceramic sheets may be optimal in width with a slightly different width than optimal patterned electrodes over continuous sheets.

Figure 6A:
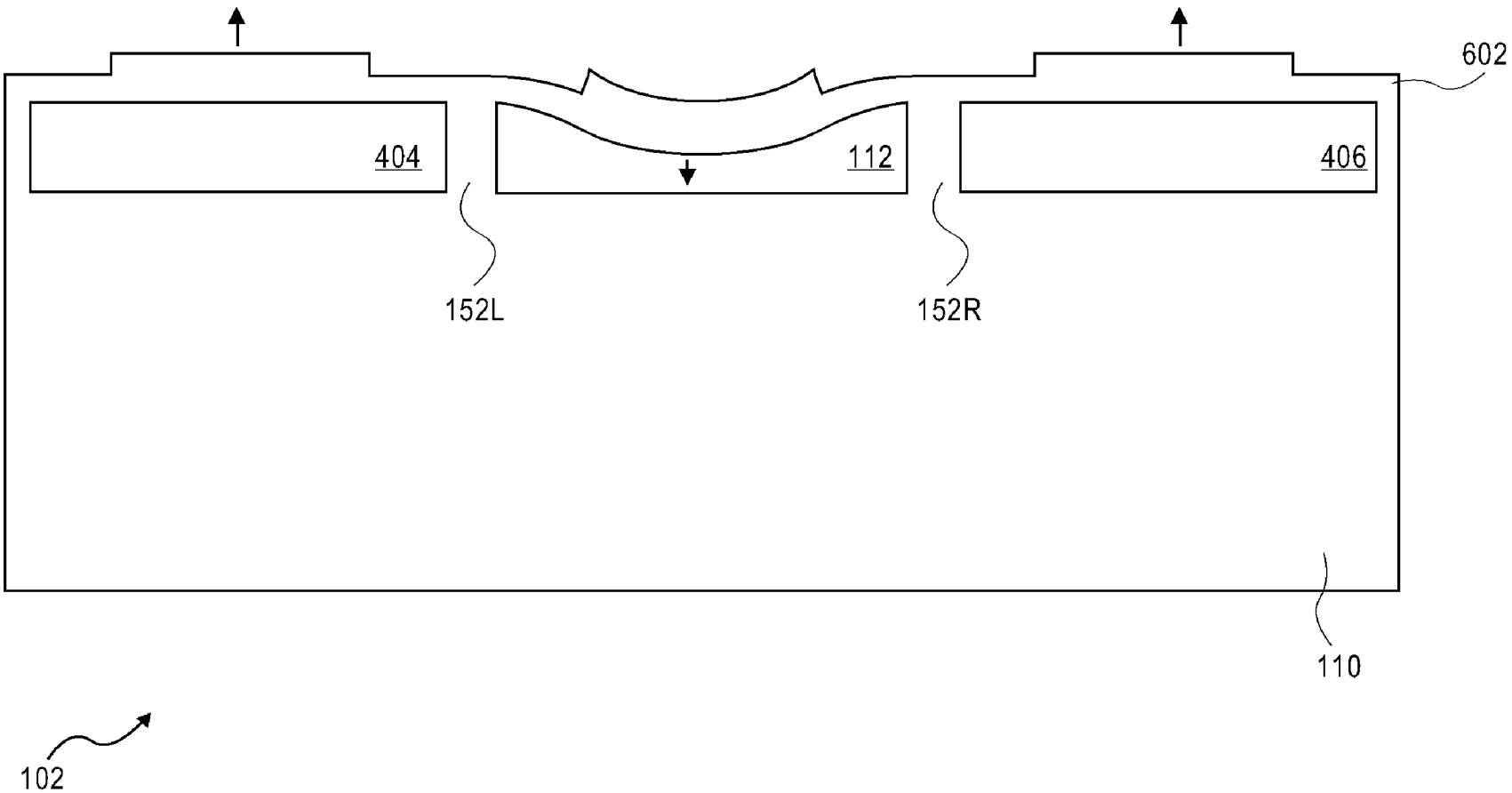
FIGS. 6A and 6B are diagrams showing how displacement occurs within the piezoelectric actuation mechanism of FIGS. 5A and 5B upon application of various voltages to various electrodes of the mechanism, according to different embodiments of the present disclosure.
Figure 6B:
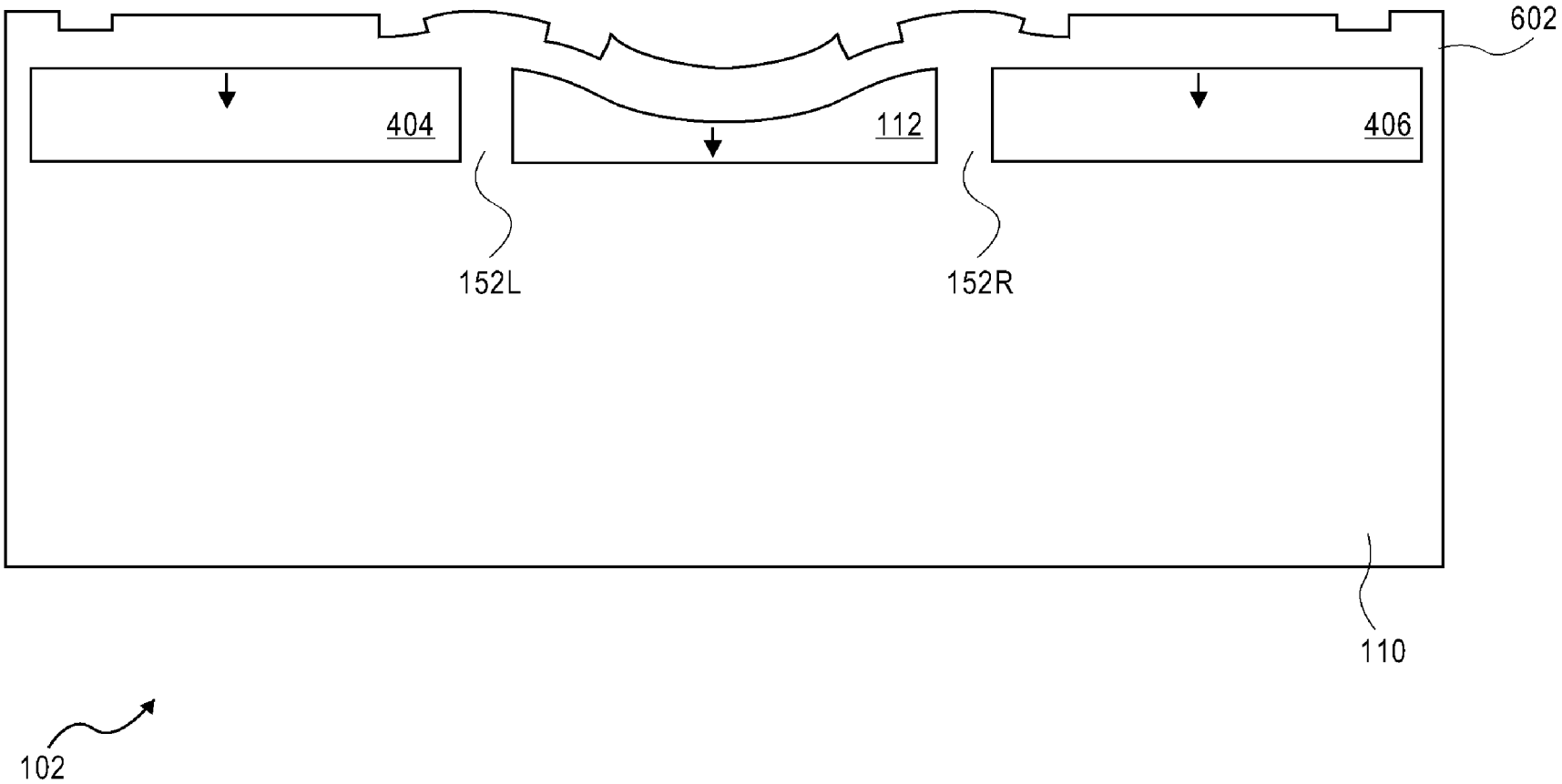

FIGS. 6A and 6B show the displacement in relation to the chamber 112 of the piezoelectric actuation mechanism 102 of FIGS. 5A and 5B caused by application of voltages to various of the electrodes 154, according to different embodiments of the present invention. For illustrative convenience and clarity, the diaphragm 114, the common electrode 116, the discontinuous and patterned piezoceramic sheet 118, and the electrodes 154 are collectively depicted in FIGS. 6A and 6B as a portion 602 of the piezoelectric actuation mechanism 102. As such, just the substrate 154, the chamber 112 defined by the substrate 154, and the sidewalls 152L and 152R also defined by the substrate 110 are depicted in FIGS. 6A and 6B.

In FIG. 6A, the center electrode 154C has a voltage of +10 volts applied thereto, while the left and the right sidewall electrodes 154L and 154R are permitted to float, to selectively actuate the chamber 112. The result is that the portion 402 of the piezoelectric actuation mechanism 102 over the chamber 112 is displaced by −82.9 nm at its maximum point, such that the chamber 112 yields a decrease in volume of −57.6 pl. The portion 602 over the chamber to the left of the chamber 112, referred to as the chamber 404, and the portion 602 over the chamber to the right of the chamber 112, referred to as the chamber 406, also are displaced, in the opposite direction, by 2.67 nm. The chambers 404 and 406 increase in volume by 0.6 pl. Thus crosstalk in the embodiment of FIG. 6A is relatively minimal.

In FIG. 6B, the left sidewall electrode 154L and the right sidewall electrode 154R have a voltage of −10 volts applied thereon, and the center electrode 154C has a voltage of +10 volts applied thereon, to selectively actuate the chamber 112. The result is that the portion 602 of the piezoelectric actuation mechanism 102 over the chamber 112 is displaced by −95.17 nm at its maximum point, such that the chamber 112 decreased in volume by 69.6 pl. The portion 602 over the adjacent chamber 404, and the portion 602 over the adjacent chamber 406, are also displaced, but just by −8.12 nm at their maximum points, with a volume decrease of just 5.4 pl in each of the chambers 404 and 406. Therefore, crosstalk as a percentage of desired chamber actuation is decreased in FIG. 6B as compared to in FIG. 6A.

Figure 7:
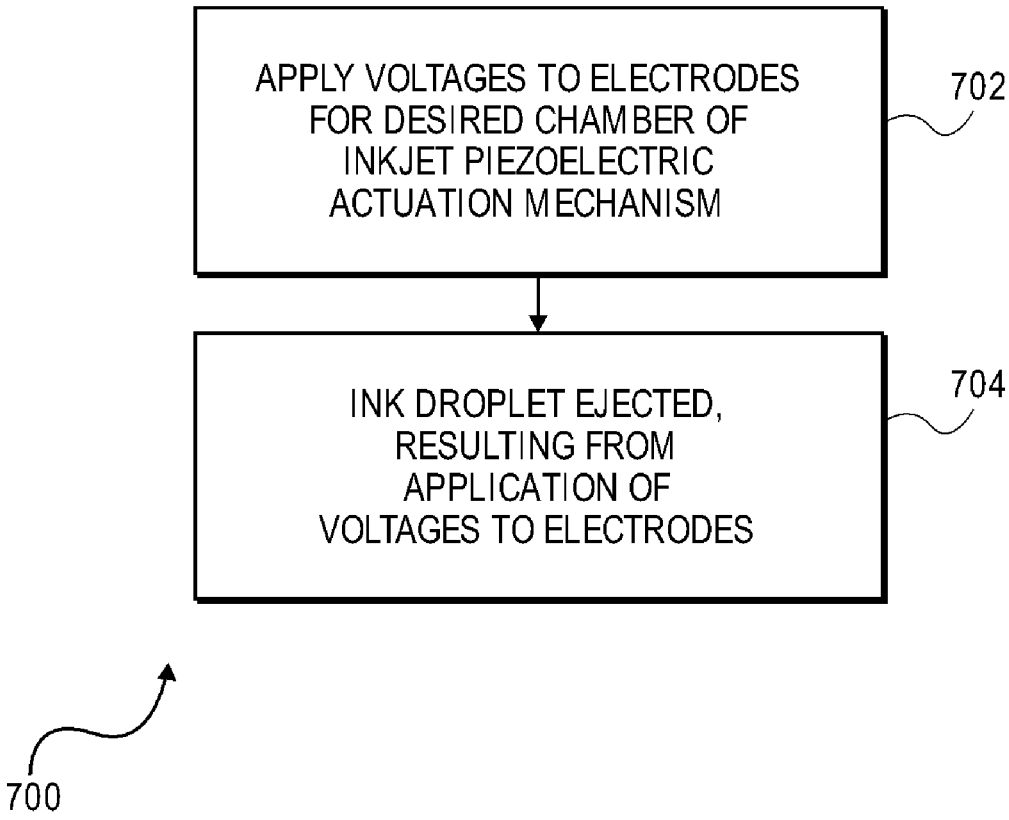
FIG. 7 is a flowchart of a method, according to an embodiment of the present disclosure.

In conclusion, FIG. 7 shows a method 700 by which the inkjet piezoelectric actuation mechanism 102 can be employed, according to an embodiment of the invention. The method 700 is performed in relation to a selected, or desired, chamber, where the chamber 112 is specifically described for example purposes. That is, it is desired that the chamber 112 be actuated to cause an ink droplet to be ejected.

A voltage is applied to each of one or more of the electrodes 154 for the chamber 112 (702). For example, a voltage may be applied to the sidewall electrodes 154L and 154R, while the center electrode 154C is permitted to float. As another example, a voltage may be applied to the sidewall electrodes 154L and 154R while the center electrode 154C is grounded. As a third example, a voltage may be applied to the center electrode 154C, while the sidewall electrodes 154L and 154R are grounded or permitted to float. As one alternative to this third example, all of the sidewall electrodes, and not just the sidewall electrodes 154L and 154R may be grounded or permitted to float. As a further example, a voltage may be applied to the center electrode 154C, and a (different) voltage applied to the sidewall electrodes 154L and 154R. As a similar alternative to this example, a voltage may be applied to all of the sidewall electrodes, and not just to the sidewall electrodes 154L and 154R.

The result of this application of voltages to the electrodes 154 is that the chamber 112 is actuated, such that an ink droplet is piezoelectrically ejected from the inkjet printing device 100 (704). It is noted that the piezoelectric actuation mechanism 102 that has been described in various embodiments of the present disclosure, and which may be operated in accordance with the method 700, can be advantageous. For instance, crosstalk may be minimized by selectively applying the voltages to the electrodes 154, and by selecting the voltages that are applied to the electrodes 154. Furthermore, in embodiments in which the piezoceramic sheet 118 is not patterned and remains continuous, fabrication of the piezoelectric actuation mechanism 102 may be achieved more quickly and/or less expensively as compared to having to pattern the piezoceramic sheet 118 into discontinuous portions.

It is noted that other schemes for actuating a given chamber may be employed, in addition to and/or in lieu of those that have been described herein. For example, a first voltage may be applied to the discrete center electrode for a chamber to be actuated, and a second voltage may be applied to the discrete sidewall electrodes for all the chambers. A third voltage may then be applied to the discrete center electrode for each chamber other than the chamber that is to be actuated. As another example, the sidewall electrodes may be segmented, or patterned, into two portions, so that just the portion immediately adjacent to the actuated chamber has a voltage applied to it. It is further noted that the relative location of the electrodes from top and bottom may be reversed for electrical access or for manufacturability.

We claim:

1. A piezoelectric actuation mechanism comprising:

a substrate having a plurality of chambers defined therein, each chamber having a first sidewall and a second sidewall;

a flexible diaphragm disposed over the chambers of the substrate and mounted to the first and the second sidewalls of each chamber;

a common electrode disposed over the flexible diaphragm, the common electrode common to all the chambers;

a piezoceramic sheet disposed over the common electrode; and, for each chamber, a discrete center electrode disposed over a center of the chamber, a first discrete sidewall electrode disposed over the first sidewall of the chamber, and a second discrete sidewall electrode disposed over the second sidewall of the chamber.

2. The piezoelectric actuation mechanism of claim 1, wherein for each chamber except for a first chamber and a last chamber:

the first sidewall of the chamber is the second sidewall of a preceding adjacent chamber, and the second sidewall of the chamber is the first sidewall of a successive adjacent chamber; and, the first discrete sidewall electrode for the chamber is the second discrete sidewall electrode for the preceding adjacent chamber, and the second discrete sidewall electrode for the chamber is the first discrete sidewall electrode for the successive adjacent chamber.

3. The piezoelectric actuation mechanism of claim 1, wherein the piezoceramic sheet is an unpatterned, continuous piezoceramic sheet.

4. The piezoelectric actuation mechanism of claim 3, wherein each chamber is actuatable by one of:

applying a voltage to the first discrete sidewall electrode for the chamber and to the second discrete sidewall electrode for the chamber while the discrete center electrode for the chamber is permitted to float;

applying the voltage to the first discrete sidewall electrode for the chamber and to the second discrete sidewall electrode for the chamber while the discrete center electrode for the chamber is grounded;

applying a voltage to the discrete center electrode for the chamber while the first discrete sidewall electrode and the second discrete sidewall electrode for the chamber are permitted to float; and, applying the voltage to the discrete center electrode for the chamber while the first discrete sidewall electrode and the second discrete sidewall electrode for the chamber are grounded.

5. The piezoelectric actuation mechanism of claim 3, wherein each chamber is actuatable by one or more of:

applying a first voltage to the discrete center electrode for the chamber and applying a second voltage to both the first discrete sidewall electrode and the second discrete sidewall electrode for the chamber;

applying the first voltage to the discrete center electrode for the chamber and applying the second voltage to the first discrete sidewall electrodes and the second discrete sidewall electrodes for all the chambers; and, applying the first voltage to the discrete center electrode for the chamber, applying the second voltage to the first discrete sidewall electrodes and the second discrete sidewall electrodes for all the chambers, and applying a third voltage to the discrete center electrode for each other chamber.

6. The piezoelectric actuation mechanism of claim 1, wherein the piezoceramic sheet is patterned into a plurality of portions, each portion corresponding to one of the electrodes for one of the chambers and having a width at least substantially equal to a width of the one of the electrodes to which the portion corresponds.

7. The piezoelectric actuation mechanism of claim 6, wherein each chamber is actuatable by applying a first voltage to the discrete center electrode for the chamber and applying a second voltage to both the first discrete sidewall electrode and the second discrete sidewall electrode for the chamber.

8. The piezoelectric actuation mechanism of claim 1, wherein the discrete center electrode for each chamber extends over the chamber without extending over the first sidewall or over the second sidewall of the chamber.

9. The piezoelectric actuation mechanism of claim 8, wherein:

the first discrete sidewall electrode for each chamber extends over the first sidewall of the chamber and extends over a first portion of the chamber; and, the second discrete sidewall electrode for each chamber extends over the second sidewall of the chamber and extends over a second portion of the chamber.

10. The piezoelectric actuation mechanism of claim 9, wherein:

the discrete center electrode for each chamber is at least substantially centered over the chamber and extends over substantially 60% of a width of the chamber;

the first discrete sidewall electrode for each chamber is at least substantially centered over the first sidewall of the chamber and extends over substantially 6% of the width of the chamber; and, the second discrete sidewall electrode for each chamber is at least substantially centered over the second sidewall of the chamber and extends over substantially 6% of the width of the chamber.

11. The piezoelectric actuation mechanism of claim 1, wherein the piezoelectric actuation mechanism is an inkjet piezoelectric actuation mechanism, such that actuation of each chamber causes an ink droplet to be ejected.

12. A method comprising:

applying one or more voltages to one or more of a discrete center electrode, a first discrete sidewall electrode, and a second discrete sidewall electrode for a chamber of an inkjet piezoelectric actuation mechanism, the discrete center electrode disposed over a center of the chamber, the first discrete sidewall electrode disposed over a first sidewall of the chamber, and the second discrete sidewall electrode disposed over a second sidewall of the chamber; and, ejecting an ink droplet as resulting from application of the one or more voltages to the one or more of the discrete center electrode, the first discrete sidewall electrode, and the second discrete sidewall electrode for the chamber of the inkjet piezoelectric actuation mechanism, wherein the inkjet piezoelectric actuation mechanism includes a piezoceramic sheet disposed over a common electrode disposed over a flexible diaphragm disposed over a substrate defining a plurality of chambers including the chamber, to enable the ink droplet to be ejected by applying the one or more voltages to the one or more of the discrete center electrode, the first discrete sidewall electrode, and the second discrete sidewall electrode for the chamber of the inkjet piezoelectric actuation mechanism.

13. The method of claim 12, wherein the piezoceramic sheet is an unpatterned, continuous piezoceramic sheet.

14. The method of claim 13, wherein applying the one or more voltages to the one or more of the discrete center electrode, the first discrete sidewall electrode, and the second discrete sidewall electrode for the chamber of the inkjet piezoelectric actuation mechanism comprises one of:

applying a voltage to the first discrete sidewall electrode for the chamber and to the second discrete sidewall electrode for the chamber while the discrete center electrode for the chamber is permitted to float;

applying the voltage to the first discrete sidewall electrode for the chamber and to the second discrete sidewall electrode for the chamber while the discrete center electrode for the chamber is grounded;

applying a voltage to the discrete center electrode for the chamber while the first discrete sidewall electrode and the second discrete sidewall electrode for the chamber are permitted to float; and, applying the voltage to the discrete center electrode for the chamber while the first discrete sidewall electrode and the second discrete sidewall electrode for the chamber are grounded.

15. The method of claim 13, wherein applying the one or more voltages to the one or more of the discrete center electrode, the first discrete sidewall electrode, and the second discrete sidewall electrode for the chamber of the inkjet piezoelectric actuation mechanism comprises one or more of:

applying a first voltage to the discrete center electrode for the chamber and applying a second voltage to both the first discrete sidewall electrode and the second discrete sidewall electrode for the chamber; and, applying the first voltage to the discrete center electrode for the chamber and applying the second voltage to the first discrete sidewall electrodes and the second discrete sidewall electrodes for all the chambers.

16. The method of claim 12, wherein the piezoceramic sheet is patterned into a plurality of portions, each portion corresponding to one of the electrodes for the chambers and having a width at least substantially equal to a width of the one of the electrodes to which the portion corresponds, and applying the one or more voltages to the one or more of the discrete center electrode, the first discrete sidewall electrode, and the second discrete sidewall electrode for the chamber of the inkjet piezoelectric actuation mechanism comprises applying a first voltage to the discrete center electrode for the chamber and applying a second voltage to both the first discrete sidewall electrode and the second discrete sidewall electrode for the chamber.

17. A piezoelectric inkjet printing device comprising:

an inkjet piezoelectric actuation mechanism to eject ink droplets from a supply of ink of the piezoelectric inkjet printing device onto media, the inkjet piezoelectric actuation mechanism comprising:

a substrate having a plurality of chambers defined therein, each chamber having a first sidewall and a second sidewall;

a flexible diaphragm disposed over the chambers of the substrate and mounted to the first and the second sidewalls of each chamber;

a common electrode disposed over the flexible diaphragm, the common electrode common to all the chambers;

a piezoceramic sheet disposed over the common electrode; and, for each chamber, a discrete center electrode disposed over a center of the chamber, a first discrete sidewall electrode disposed over the first sidewall of the chamber, and a second discrete sidewall electrode disposed over the second sidewall of the chamber.

18. The piezoelectric inkjet printing device of claim 17, wherein for each chamber except for a first chamber and a last chamber:

the first sidewall of the chamber is the second sidewall of a preceding adjacent chamber, and the second sidewall of the chamber is the first sidewall of a successive adjacent chamber; and, the first discrete sidewall electrode for the chamber is the second discrete sidewall electrode for the preceding adjacent chamber, and the second discrete sidewall electrode for the chamber is the first discrete sidewall electrode for the successive adjacent chamber.

19. The piezoelectric inkjet printing device of claim 17, wherein the piezoceramic sheet is an unpatterned, continuous piezoceramic sheet.

20. The piezoelectric inkjet printing device of claim 17, wherein the piezoceramic sheet is patterned into a plurality of portions, each portion corresponding to one of the electrodes for one of the chambers and having a width at least substantially equal to a width of the one of the electrodes to which the portion corresponds.

* * * * *